US006773312B2

(12) United States Patent
Bauer et al.

(10) Patent No.: US 6,773,312 B2
(45) Date of Patent: Aug. 10, 2004

(54) ELECTRICAL PRESSURE CONTACT

(75) Inventors: Monika Bauer, Bruchsal (DE); Frank Moskob, Karlsruhe (DE); Robert Dost, Ölbronn (DE); Bernd Schumann, Bretten (DE); Andreas Kainz, Heilbronn (DE); Jürgen Veit, Bretten (DE)

(73) Assignee: era-contact GmbH, Bretton (DE)

( * ) Notice: Subject to any disclaimer, the term of this patent is extended or adjusted under 35 U.S.C. 154(b) by 0 days.

(21) Appl. No.: 10/226,401

(22) Filed: Aug. 23, 2002

(65) Prior Publication Data

US 2003/0049974 A1 Mar. 13, 2003

(30) Foreign Application Priority Data

Sep. 4, 2001 (DE) ..... 101 43 200

(51) Int. Cl.[7] ..... H01R 4/24
(52) U.S. Cl. ..... 439/824; 439/816; 439/840
(58) Field of Search ..... 439/824, 819, 439/840, 846, 848, 10, 842, 877, 29

(56) References Cited

U.S. PATENT DOCUMENTS 2,724,096 A * 11/1955 Klostermann ..... 339/255
3,813,772 A * 6/1974 Adams ..... 29/624
4,743,201 A * 5/1988 Robinson et al. ..... 439/103
5,641,315 A * 6/1997 Swart et al. ..... 439/824

FOREIGN PATENT DOCUMENTS

| | | |
|---|---|---|
| DE | 27 23 731 A1 | 11/1978 |
| DE | 43 17 255 C2 | 1/1996 |
| EP | 0 435 408 B1 | 7/1991 |
| FR | 2 545 993 A1 | 11/1984 |

* cited by examiner

*Primary Examiner*—Alex Gilman
(74) *Attorney, Agent, or Firm*—McCormick, Paulding & Huber LLP

(57) ABSTRACT

An electrical pressure contact includes a housing sleeve with an end facing the contact and an end facing away from the contact, a contact pin axially slidably supported in the housing sleeve, which pin extends out of the housing sleeve at the side facing the contact, which pin is a pushable into the housing sleeve against the biasing force of the a biasing element arranged in the housing sleeve, and through the conductive body of which pin the electrical contact is made, a terminal piece for fastening to an electrical supply conductor at the end of the housing facing away from the contact, and an axially flexible electrical conductor arranged in the housing sleeve between the terminal piece and the contact pin. The flexible electrical conductor is at its end facing the contact clamped into an axial bore formed in the end of the contact pin facing away from the contact and at its end facing away from the contact is clamped in an axial bore formed in the end of the terminal piece facing the contact.

16 Claims, 3 Drawing Sheets

ELECTRICAL PRESSURE CONTACT

CROSS-REFERENCE TO RELATED APPLICATIONS

This application is entitled to the benefit of and incorporates by reference essential subject matter disclosed in German Patent Application No. 101 43 200.3 filed on Sep. 4, 2001.

FIELD OF THE INVENTION

The present invention concerns an electrical pressure contact, including:

- a housing sleeve with a contact facing end and an end facing away from the contact,
- a contact pin axially slidably supported in the housing sleeve, which contact pin extends out of the contact facing end of the housing sleeve, is pushable into the housing sleeve against the biasing force of a biasing element arranged in the contact sleeve, and through whose conductive body the electrical contact is made,
- a terminal piece for the fastening of an electrical supply conductor to the end of the housing sleeve facing away from the contact, and
- a flexible electrical conductor arranged in the housing sleeve between the terminal piece and the contact pin.

BACKGROUND OF THE INVENTION

Electrical pressure contacts of this type serve, for example, to conduct current between elements which are movable relative to one another. Therefore the contact pin has a two-fold function: On one hand it can make a spring-loaded mechanical contact with an opposite contact movable relative to the housing sleeve. On the other hand, an electrical contact can be made through its current conducting body. Electrical pressure contacts of this type are used in large numbers, especially in railroad couplings.

In customary electrical pressure contacts of the above-mentioned kind, the flexible electric conductor is formed by strands, which are rigidly soldered to the contact pin and to the terminal piece. Generally, several strands are pleated and are so pre-twisted that they can accommodate a pushing of the contact pin into the housing sleeve without the strands becoming bucked, to avoid damage to the strands. Nevertheless, in customary electrical pressure contacts, as a result of a large number of contact reciprocations, the strands unfortunately often become damaged, especially broken. Moreover, the making of such electrical pressure contacts is relatively time consuming and expensive.

EP-O-435 408 B1 shows an electrical pressure contact intended to avoid these problems. In a case of this pressure contact, no stranded conductors are used. Instead of this, the contact pin is partially formed as a hollow cylinder whose wall is provided with several longitudinal slots, whereby wall sectors are achieved which are formed as springy, current conducting contact tongues. These contact tongues, on their inner sides, lie slidable on a current conducting housing sleeve, so that current can flow through the contact tongues and the housing sleeve to the terminal piece. The making of such a stranded conductor-free pressure contact is, however, similarly expensive.

DE-4-317 255 C2 shows an electrical pressure contact for completely-automatic or semi-automatic railroad vehicle coupling with a housing sleeve of plastic and a sliding sleeve slidably supported in the housing sleeve, which sliding sleeve transitions into a hollow formed contact pin. A metallic contact sleeve is insertable into this hollow contact pin from the outside, which metallic contact sleeve at its contact facing side carries a contact plate, and at its side facing away from the contact is crimped to a cable end. In this type of pressure contact, the contact pin therefore creates only a mechanical contact, while the electric contact has to be created through a conductor positioned in the interior of the contact pin. Such a construction requires therefore an increased number of construction components and a more expensive assembly, which increases the production costs.

SUMMARY OF THE INVENTION

The invention has as its object the provision of an electrical pressure contact of the previously mentioned kind, which is of simple construction, can be made economically, and which has a long service life, that is, can withstand an especially high number of contact reciprocations without damage.

This object is solved by way of an electrical pressure contact of the aforementioned kind in that the braided tubular conductor at its end facing the contact is clamped in a bore formed in the end of the contact pin facing away from the contact, and at its end facing away from the contact is clamped into an axial bore formed in the end of the terminal piece facing the contact.

Further, the respective sections of the contact pin and of the terminal piece into which the conductor ends are inserted in the bores, are pressed radially inwardly and with a pressure which is so measured that the braided tubular conductor on one hand is sufficiently clamped so that it cannot become loosened and provides a good electrical contact, and on the other hand that the braided tubular conductor is not damaged by the pressing. This type of fastening is called crimping.

By the direct crimping of the conductor with the contact pin and with the terminal piece, the construction of the electrical pressure contact of the invention is simple and its manufacture is economical. Especially, its manufacture is significantly less expensive than in the case of soldered connections.

In contrast to a pressure contact with soldered connections, the pressure contact of the invention has a higher service life. For one thing, with an overheating of a soldered pressure contact, the danger exists that the solder becomes plastic and the stranded conductor "unsolders itself", that is, the connection becomes unmade. As another thing, in the case of a soldered stranded conductor, the danger of breakage is higher than in the case on a crimped stranded conductor. Among other things, that is because in the case of soldering solder can penetrate from the soldered location through the flexible conductor and stiffen the flexible conductor with the result that the flexible conductor is easily broken by the axial movement of the contact pin.

In a preferred embodiment the biasing mechanism is formed by a helical spring.

In a preferred embodiment, the flexible electrical conductor is formed by a braided tubular conductor. A braided tubular conductor having at least some degree of flexibility can fan out under axial loading and in this way can accommodate the axial loading without the strands of the stranded conductor becoming buckled and thereby broken. Since a braided tubular conductor is compressible in the axial direction, it can be simply arranged along the housing sleeve axis. This represents a large simplification in comparison to the stranded conductors used in customary pressure contacts, which for example are assembled with a given preliminary twisting between the contact pin and the terminal piece so that they upon axial loading lie together in loops. To make such a preliminary twisting, the contact pin must always be rotated in a given way relative to the terminal piece. This requires means for holding the contact pin in the rotated position. In the pressure contact of the invention with a braided tubular conductor such means are however not required, which benefits a simple construction of the pressure contact.

In an advantageous development, the flexible electrical conductor is a braided tubular conductor made of strands of copper. A braided tubular conductor can especially well accommodate an axial compression without thereby becoming damaged. A braided tubular conductor can therefore be designed relatively large while still providing a sufficient flexibility. That is, it can indude a large number of strands so that the electrical resistance of the pressure contact is lowered.

In a further preferred embodiment, the flexible electrical conductor is formed by the helical spring. This spring can in a way similar to the described stranded conductor be crimped to the contact pin and to the terminal piece. This leads to a yet simpler construction of the pressure contact and to a yet lower manufacturing cost. Moreover, such type of pressure contact is of a significantly higher service life because the danger of breaking the flexible conductor by reciprocations of the contact is practically foreclosed.

In the event the helical spring does not serve for the transmission of current, the terminal piece in a preferred embodiment has a first cylindrical section facing the contact which is arranged coaxial with the housing sleeve and is received in the end of the helical spring facing away from the contact. Thereby, the helical spring, at its end facing away from the contact, is held in position in a simple way.

The contact pin preferably has in its circumferential surface a surrounding groove arranged perpendicularly to the pin axis, in which groove a locking ring is received, which locking ring on its side facing the contact forms a stop for an inwardly facing radial shoulder on the end of the sleeve facing the contact, and which locking ring on its side facing away from the contact forms a stop for the spring. If the spring is not crimped to the contact pin for the transmission of current, it sits on the side of the locking ring facing away from the contact and thereby presses the contact pin in the contact direction. The movement of the contact pin in the contact direction is limited in that the side of the locking spring facing the contact engages the inwardly facing shoulder of the housing sleeve. The construction with the locking ring and groove is decidedly simple and economical to make. Especially, the contact pin, except for the groove, can have a simple cylindrical circumference which is favorable for its manufacture.

In an advantageous way, the terminal piece has a second cylindrical section whose diameter corresponds to the internal diameter of the housing sleeve and which has a crimping surface over which the housing sleeve is crimped. Such a crimped connection between the terminal piece and the housing sleeve is robust and economical to manufacture.

In an advantageous further development, the mentioned crimping surface has a surrounding groove. The housing sleeve is pressed into this groove and is thereby rigidly connected with the terminal piece.

Preferably the terminal piece has on the side of the second cylindrical section facing away from the contact an axially arranged threaded bolt for connection to the electrical supply conductor.

Preferably the contact pin has a rounded contact surface facing the contact. The rounding of the contact surface has the effect that the contact pin can make contact with an opposed contact surface even if it does not exactly perpendicularly encounter the opposing contact surface. In a preferred further development, the rounded contact surface is gold-plated to avoid corrosion which would impair the electrical contact.

In a further preferred embodiment, a contact pin of silver is inserted into the end of the contact pin facing the contact. By way of such a contact pin, a very well conducting, corrosion resisting contact is formed. In an advantageous further development the contact pin has a gold-plated contact surface.

In a preferred embodiment, the housing sleeve contact pin and terminal piece are made of brass with a small amount of lead, especially from CuZn38Pb2. Such a material is sufficiently conductive, economical, machinable, and crimpable after a suitable heat treatment. It allows therefore a simple, rapid, and economical manufacture of the pressure contact. A housing sleeve made of this material is in the case of similar wall thicknesses significantly more stable than one made of plastic. Such an electrical pressure contact has in itself, that is, without the inclusion of a plastic plate or the like, a high stability and is therefore universally usable.

BRIEF DESCRIPTION OF THE DRAWINGS

Further advantages and features of the inventive solution will be apparent from the following description, which in combination with the accompanying drawings, explain the invention by way of three exemplary embodiments. The drawings are.

DETAILED DESCRIPTION OF THE PREFERRED EMBODIMENTS

Figure 1:
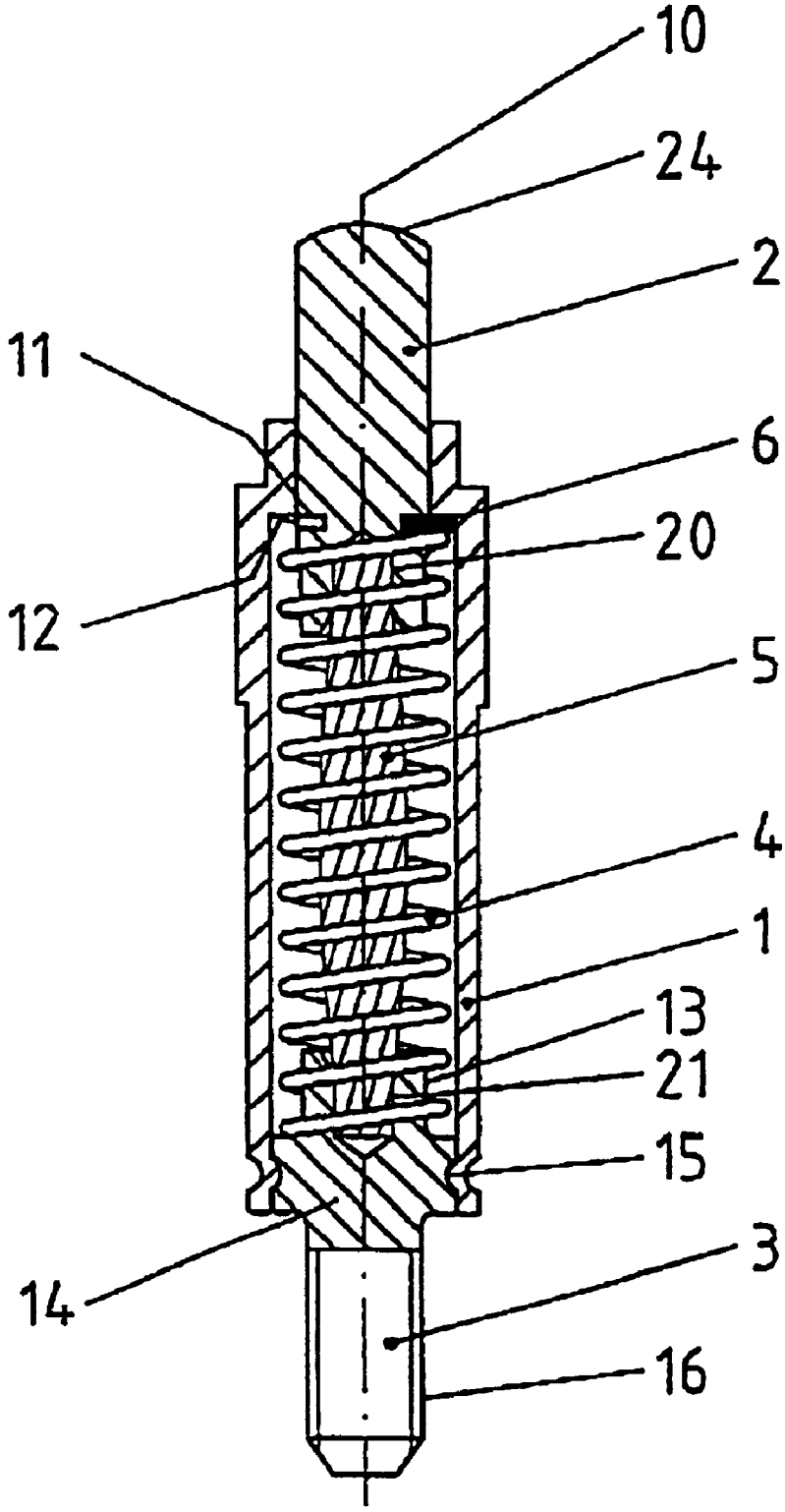
FIG. 1 a longitudinal section through an electrical pressure contact embodying the invention with a braided tubular conductor and a gold-plated contact surface, FIG. 2 a longitudinal section through an pressure contact embodying the invention with a braided tubular conductor and a silver contact pin, FIG. 3 A longitudinal section through an electrical pressure contact embodying the invention in which the braided tubular conductor between the contact pin and the terminal piece is formed by the helical spring which biases the contact pin.
Figure 2:
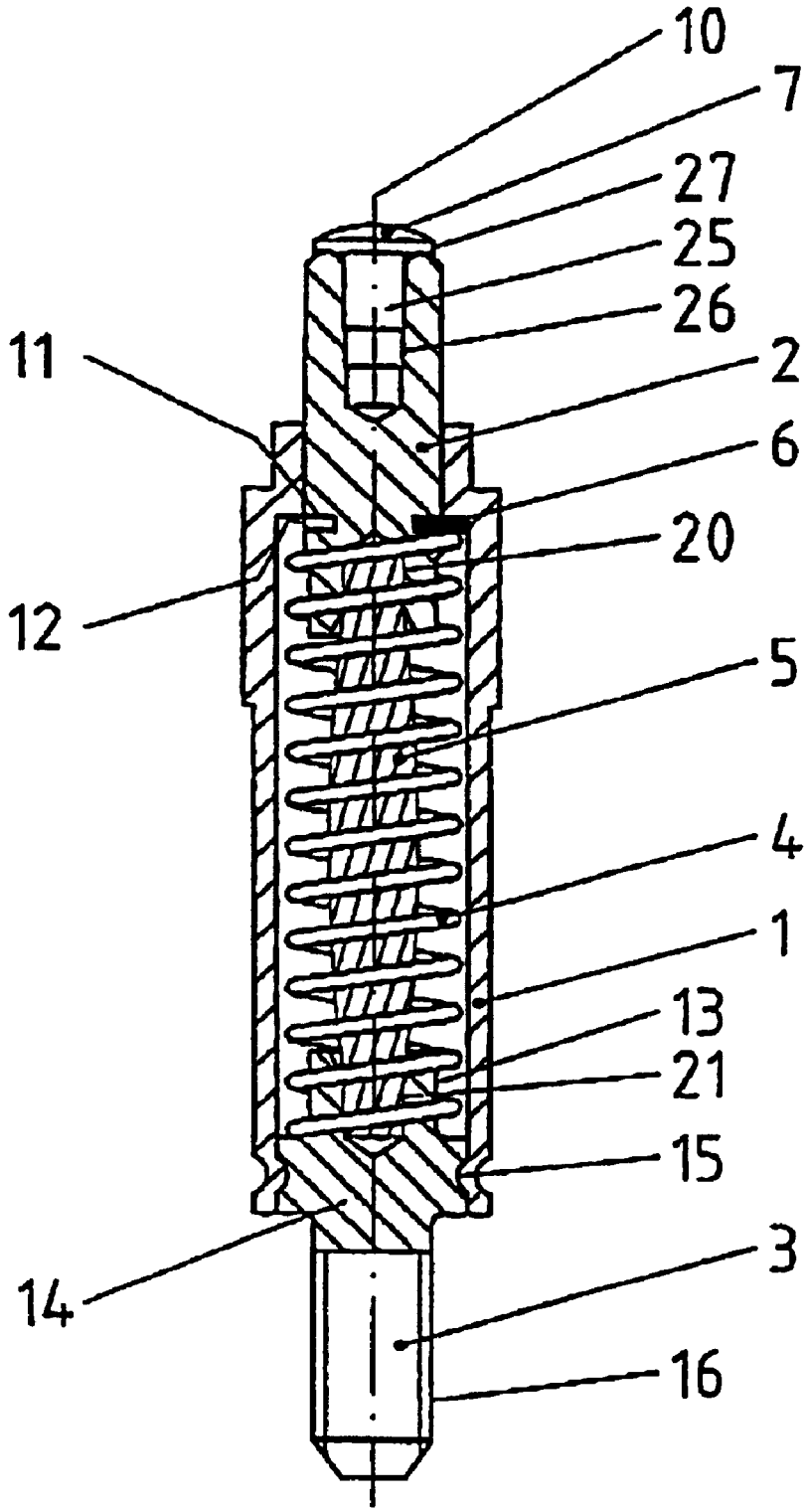
Figure 3:
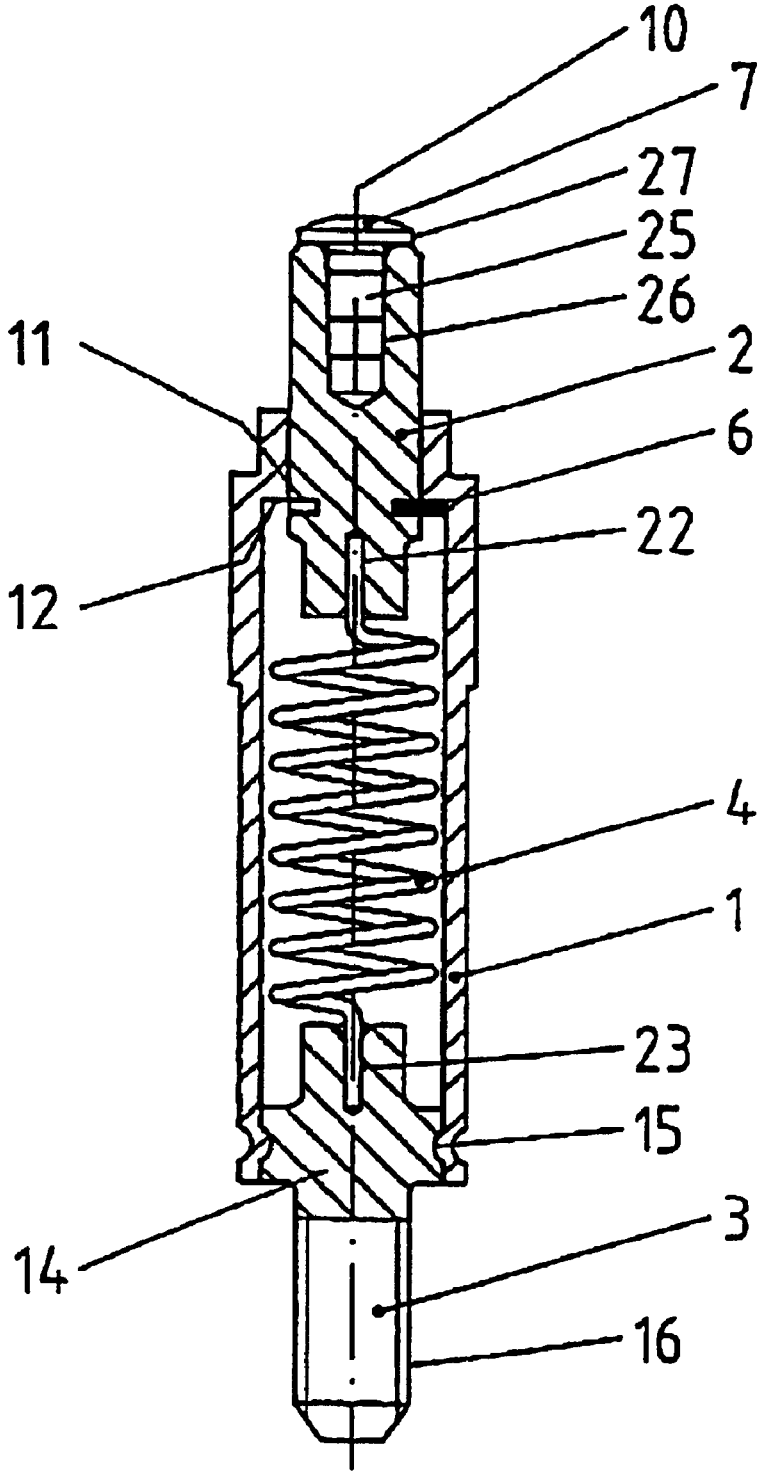

FIGS. 1 through 3 show different embodiments of electrical pressure contacts embodying the invention with a housing sleeve 1, which housing sleeve has a contact facing end (upper in FIGS. 1 to 3) and an end (lower in FIGS. 1 to 3) facing away from the contact. The housing sleeve axis is indicated by the reference number 10.

A contact pin 2 is axially slidably supported in the housing sleeve 1. This contact pin is biased in the contact direction by a helical spring 4.

The contact pin has a surrounding groove 11 in its circumferential surface, which groove is oriented perpendicular to the axis 10. A locking ring 6 is received in this groove, which locking ring, with its side facing the contact (upper side in FIGS. 1 through 3) can come into engagement with a radial inwardly facing shoulder 12 of the housing sleeve. By way of the locking ring 6 and the housing sleeve shoulder 12, the movability of the contact pin in the contact direction is limited.

In FIGS. 1 and 2, the helical spring 4 engages the side of the locking ring 6 facing away from the contact. At the end of the housing sleeve 1 facing away from the contact, the housing sleeve 1 is closed by a terminal piece 3. In FIGS. 1 and 2, the helical spring engages this terminal piece 3 with its end facing away from the contact. The terminal piece 3 has a first cylindrical section 13 facing the contact, the diameter of which is smaller than the internal diameter of the spring 4. In FIGS. 1 and 2, this cylindrical section 13 is received in the spring 4 and holds the spring in position.

The terminal piece 3 has a second cylindrical section 14, the diameter of which corresponds to the internal diameter of the housing sleeve 1. On its cylindrical circumferential surface is a surrounding groove 15. The circumferential surface of the cylindrical section 14, with its surrounding groove 15, forms a crimping surface over which housing sleeve 11 is crimped. To the side of the cylindrical section 14 facing away from the contact is connected an axially arranged threaded bolt 16 to which an electrical supply conductor can be connected in a known way. The biased contact pin 2 of the described kind can therefore make a spring loaded mechanical pressure contact with an opposite contact. In the illustrated examples of pressure contacts embodying the invention, the contact pin 2 and the terminal piece 3 are made of CuZn38Pb2. This material is sufficiently conductive to create an electrical contact through contact pin 2 and terminal piece 3. Contact pin 2 and terminal piece 3 are connected by way of an axially flexible electrical conductor.

In FIGS. 1 and 2, the flexible electric conductor is formed by a flexible braided stranded tube of copper to provide the resulting braided tubular conductor 5. This braided tubular conductor 5 has one end inserted into a bore 20 in the contact pin 2 and has its other end inserted into a bore 21 in the terminal piece 3, and each end is rigidly damped in its respective bore 20 or 21. That is, the corresponding sections of the contact pin 2 and of the terminal piece 3 with the inserted braided tubular conductor 5 are pressed radially inwardly and with a pressure which is so measured that the strands of the braided tubular conductor 5 are rigidly enough pinched that they cannot loosen and that a good electrical contact is supplied, without on the other hand these strands being damaged by the pressure. This type of fastening is called crimping.

By way of the direct crimping of the braided tubular conductor 5 with the contact pin and with the terminal piece, the pressure contact of the invention distinguishes itself from customary pressure contacts in which a cable or stranded wire is rigidly soldered to the contact pin and to the terminal piece. The crimping of the strands offers, in comparison to a soldering of the strands, the advantage that in manufacturing it is less expensive and the service life of the pressure contact is increased. For in the case of a soldered strand there exists the danger that in the event of overheating the pressure contact may become unsoldered. Moreover, the stranded cable can become stiffened by the solder and therefore more easily breakable.

In use of a pressure contact, the contact pin 2 is pushed into the housing sleeve 1 and the braided tubular conductor 5 is axially compressed. Such an axial compression can be optimally accommodated by the braided tubular conductor 5 in that it fans out. This therefore avoids the individual strands of the braided tubular conductor 5 becoming kinked and breaking whereby the service life of the electrical pressure contact of the invention is increased.

In the case of customary pressure contacts, generally several stranded conductors are pleated and are assembled with the housing sleeve 1 with a given preliminary twist, so that upon axial compression they lie in loops without buckling. In connection with this it must be assured that the contact pin 2 is held at a given fixed angular position relative to the housing 1. A customarily used rotation guard for this purpose is therefore not required with the braided tubular conductor 5 of the pressure contact of the invention, which simplifies the construction and reduces the manufacturing costs. Since a braided tubular conductor 5 can especially well accommodate an axial compression, it can be designed entirely larger, that is, to contain a larger number of conductor strands, without it becoming too stiff and therefore susceptible to failure. Therefore the pressure contact with the braided tubular conductor 5 of the invention can be designed especially for the transmission of higher currents.

In a further embodiment of the pressure contact of the invention, the braided tubular conductor between the contact pin 2 and the terminal piece 3 is formed alone by the helical spring 4, which at the same time biases the contact pin 2. One such electrical pressure contact is illustrated in FIG. 3. The contact pin 2 has on its side facing away from the contact an axial bore 22, and the terminal piece 3 on its side faring the contact has and axial bore 23. The ends of the spring 4 are received in these bores and are crimped to the contact pin and the terminal piece respectively. Such construction is simple and of high service life because the spring 4 is not sensitive to compression.

In FIG. 1, the contact pin 2 has a rounded gold-plated contact surface 24. Because of the rounding, a good electrical contact can be made through this contact surface with an opposite contact surface, even if the contact pin 2 does not encounter the opposite contact surface entirely perpendicularly. Alternatively, the contact pin 2 can be provided with a silver pin 7, which is illustrated in FIGS. 2 and 3. The silver pin 7 has an elongated section 25 by means of which it is received in an axial bore 26 of the contact pin 2. The pin further has a head 27 with a pre-curved contact surface facing toward the contact, which contact surface can likewise be gold plated.

In all of the described embodiments, the electrical pressure contact of the invention is distinguished by a simple construction of a few simply made and quickly and economically assembled pieces. For example, the contact pin in FIGS. 1 and 2 has an essentially cylindrical form, which in the illustrations is narrowed down only as a result of the crimping with the braided tubular conductor 5. This especially requires no two-part construction with sections of different diameters to provide a stop for the shoulder 12. The terminal piece 3 makes possible at the same time the fastening of the braided tubular conductor 5 and/or spring 4, the closure of the housing sleeve 1 by means of the cylindrical crimp surface provided with the groove 15, and the connection of a supply conductor by a threaded bolt 16. The crimped connection shown in the illustrations between the second cylindrical section 14 of the terminal piece 3 and the housing sleeve 1 is quickly and economically made and is very robust. In the illustrated examples the housing sleeve 1 is likewise made of CuZn38Pb2, which is economical, machinable, current conducting and crimpable, and thereby permits a rapid, simple and economical manufacture of the electrical pressure contact of the invention.

What is claimed is:

1. An electrical pressure contact, comprising:

a housing sleeve with a contact facing end and an end facing away from the contact, a contact pin slidably supported in the housing sleeve, which pin at the contact facing side of the housing sleeve protrudes out of the housing sleeve, is pushable into the housing sleeve against the bias of a biasing element arranged in the housing sleeve, and through its conductive body an electrical contact is made, a terminal piece at the end of the housing sleeve facing away from the contact for the fastening of an electric supply conductor, and an axially flexible electric conductor arranged in the housing sleeve between the terminal piece and the contact pin, said flexible electric conductor being a braided tubular conductor, characterized in that the flexible electric conductor at its end facing the contact is clamped in an axial bore in the end of the contact pin facing away from the contact and at its end facing away from the contact is clamped in an axial bore formed in the end of the terminal piece facing the contact.

2. An electrical pressure contact according to claim 1, further characterized in that the housing sleeve, the contact pin, and the terminal piece are made of brass with a small amount of lead, especially of CuZn38Pb2.

3. An electrical pressure contact according to claim 1, further characterized in that the braided tubular conductor comprises strands of a conductor material.

4. An electrical pressure contact according to claim 3, further characterized in that the conductor material of the braided tubular conductor comprises strands of copper.

5. An electrical pressure contact according to claim 1, further characterized in that the contact pin has a rounded contact surface facing the contact.

6. An electrical pressure contact according to claim 5, further characterized in that the contact surface is gold plated.

7. An electrical pressure contact according to claim 1, further characterized in that a contact pin of silver is inserted into the end of the contact pin facing the contact.

8. An electrical pressure contact according to claim 7, further characterized in that the contact pin has a gold-plated contact surface.

9. An electrical pressure contact according to claim 1, further characterized in that the terminal piece has a second cylindrical section whose diameter corresponds to the internal diameter of the housing sleeve and has a crimping surface over which the housing sleeve one is crimped.

10. An electrical pressure contact according to claim 9, further characterized in that the crimping surface has a groove surrounding the second cylindrical section.

11. An electrical pressure contact according to claim 9, further characterized in that the terminal piece on the side of the second cylindrical section facing away from the contact has an axially arranged threaded bolt for connection with the electrical supply conductor.

12. An electrical pressure contact according to claim 1, further characterized in that the biasing element is a helical spring.

13. An electrical pressure contact according to claim 12, further characterized in that the terminal piece has a first cylindrical section facing the contact, which first cylindrical section is arranged coaxial with the housing sleeve and is received in the helical spring.

14. An electrical pressure contact according to claim 12, further characterized in that the contact pin has in its circumferential surface a surrounding groove arranged perpendicularly to the contact pin axis, in which groove a locking ring is received, which locking ring on its side facing the contact forms a stop for a radial inwardly facing shoulder on the end of the housing facing the contact and on its side facing away from the contact forms a stop for the spring.

15. An electrical pressure contact according to claim 12, further characterized in that the flexible electric conductor is formed by the helical spring.

16. An electrical pressure contact according to claim 15, further characterized in that the contact pin in its circumferential surface has a surrounding groove arranged perpendicularly to the pin axis in which a locking ring is received, which locking ring on its side facing the contact forms a stop for a radial inwardly facing shoulder at the end of the housing facing the contact.

* * * * *